US008867961B2

(12) United States Patent
Nakazato

(10) Patent No.: US 8,867,961 B2
(45) Date of Patent: Oct. 21, 2014

(54) IMAGE FORMING APPARATUS CAPABLE OF PREVENTING BELT FROM MEANDERING

(75) Inventor: Jun Nakazato, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 144 days.

(21) Appl. No.: 13/483,956

(22) Filed: May 30, 2012

(65) Prior Publication Data

US 2012/0321328 A1 Dec. 20, 2012

(30) Foreign Application Priority Data

Jun. 17, 2011 (JP) ..... 2011-135105

(51) Int. Cl.
*G03G 15/00* (2006.01)
*G03G 15/01* (2006.01)
*G03G 15/16* (2006.01)

(52) U.S. Cl.
CPC ..... *G03G 15/1615* (2013.01); *G03G 15/0136* (2013.01); *G03G 15/161* (2013.01); *G03G 2215/00156* (2013.01); *G03G 2215/0119* (2013.01)
USPC ..... 399/165

(58) Field of Classification Search
CPC ..... G03G 15/00
USPC ..... 399/165
See application file for complete search history.

(56) References Cited

U.S. PATENT DOCUMENTS

2003/0129000 A1* 7/2003 Lee et al. ..... 399/165
2009/0169274 A1* 7/2009 Suzuki et al. ..... 399/302
2009/0180805 A1* 7/2009 Nakura et al. ..... 399/165

FOREIGN PATENT DOCUMENTS

JP 07225543 A * 8/1995 ..... G03G 15/00
JP 09060693 A * 3/1997 ..... F16H 7/00
JP 11072980 A * 3/1999 ..... G03G 15/00
JP 2000264479 A * 9/2000 ..... G03G 15/00
JP 2005326638 A * 11/2005 ..... G03G 21/00
JP 2006267953 A * 10/2006 ..... G03G 15/01
JP 2009-145765 A 7/2009
JP 2009-157105 A 7/2009
JP 2009-282196 A 12/2009
JP 2010-145556 A 7/2010

* cited by examiner

*Primary Examiner* — Nguyen Ha
(74) *Attorney, Agent, or Firm* — Canon USA Inc IP Division

(57) ABSTRACT

An image forming apparatus includes a storage unit configured to store a first tilted position of a roller at which meandering of the belt can be prevented in a state that the belt abuts on the image bearing member and a second tilted position of the roller at which meandering of the belt can be prevented in a state that the belt is separated from the image bearing member, and a control unit configured to move the roller to the first tilted position if the belt abuts on the image bearing member while the belt is conveyed and move the roller to the second tilted position if the abutment of the belt on the image bearing member is cancelled while the belt is conveyed.

5 Claims, 9 Drawing Sheets

WITH CAM POSITION CORRECTION CONTROL

WITHOUT CAM POSITION CORRECTION CONTROL

SECONDARY TRANSFER ROLLER ABUTMENT/ SEPARATION STATE

SECONDARY TRANSFER ROLLER
IN SEPARATION STATE
(COLOR IMAGE ADJUSTMENT MODE)

SECONDARY TRANSFER
ROLLER IN ABUTMENT STATE
(COLOR PRINT MODE)

IMAGE FORMING APPARATUS CAPABLE OF PREVENTING BELT FROM MEANDERING

BACKGROUND OF THE INVENTION

1. Field of the Invention

The present invention relates to an image forming apparatus configured to form a toner image on a recording sheet via the charging, exposure, development, and transfer processes of an electrophotographic method.

2. Description of the Related Art

Conventionally, there is a tandem type image forming apparatus which includes four photosensitive drums for yellow, magenta, cyan, and black colors and an intermediate transfer belt onto which a toner image is transferred from each of the photosensitive drums. As discussed in Japanese Patent Application Laid-Open No. 2010-145556, when forming an image, the conventional tandem type image forming apparatus controls the intermediate transfer belt to abut onto the four photosensitive drums in a color print mode and to separate from the three photosensitive drums excluding the drum for the black color in a monochrome print mode.

The abutment operation of the intermediate transfer belt against the photosensitive drum is performed by moving a primary transfer roller closer to the photosensitive drum. The separation operation of the intermediate transfer belt from the photosensitive drum is performed by moving the primary transfer roller away from the photosensitive drum.

In the ideal state, the intermediate transfer belt is conveyed without moving in the direction perpendicular to the movement direction of the intermediate transfer belt (i.e., in the width direction). However, it is known that the intermediate transfer belt tends to move in the width direction due to various factors, such as the tilt of a roller that supports the intermediate transfer belt, a tension difference between the left and the right sides of the intermediate transfer belt, and a difference in the external load. When the intermediate transfer belt moves in the width direction, meandering may occur. As a technique for correcting such meandering of the intermediate transfer belt, Japanese Patent Application Laid-Open No. 2009-282196 discusses a technique that corrects the meandering by tilting a steering roller.

However, if the intermediate transfer belt is attached to the photosensitive drum or the intermediate transfer belt is separated from the photosensitive drum when the intermediate transfer belt is conveyed in a stable manner, the stability of the conveyance of the intermediate transfer belt may be affected. This is because, the abutment operation or the separation operation may change a pressing force from the photosensitive drum and the primary transfer roller and a position that receives the pressing force, which causes a change in the angle of the tilt of the steering roller that can realize the stable conveyance of the intermediate transfer belt. Thus, when the abutment operation or the separation operation is performed, a large meandering of the intermediate transfer belt temporarily occurs.

Such a meandering occurs not only when the primary transfer roller is involved. In other words, it is an issue that occurs when a rotatable member is involved in the abutment and separation operation with respect to the intermediate transfer belt. Further, the issue occurs not only with the intermediate transfer belt but also with other types of belts, such as a conveyance belt that conveys a recording sheet, having a rotatable member involved in the abutment and separation operation.

SUMMARY OF THE INVENTION

The present invention is directed to a technique capable of preventing a belt from meandering that occurs when the belt abuts on or is separated from the image bearing member while the belt is conveyed, and reducing the time that elapses before the belt is stably conveyed, thereby enabling an increase in productivity.

According to an aspect of the present invention, an image forming apparatus includes an image bearing member configured to carry a toner image, a belt configured to move in a predetermined direction, an abutment unit configured to attach the image bearing member to the belt, a roller configured to support the belt in a movable manner, a tilting unit configured to tilt a shaft of the roller, a detection unit configured to detect a position of the belt in a direction perpendicular to the predetermined direction, a control unit configured to control a tilt of the roller tilted by the tilting unit based on a detection result of the detection unit, and a storage unit configured to store a first tilted position of the roller at which meandering of the belt can be prevented in a state that the image bearing member abuts on the belt and a second tilted position of the roller at which meandering of the belt can be prevented in a state that the image bearing member is separated from the belt, wherein the control unit moves the roller to the first tilted position if the image bearing member abuts on the belt while the belt is conveyed and moves the roller to the second tilted position if the abutment of the image bearing member on the belt is cancelled while the belt is conveyed.

Further features and aspects of the present invention will become apparent from the following detailed description of embodiments with reference to the attached drawings.

BRIEF DESCRIPTION OF THE DRAWINGS

The accompanying drawings, which are incorporated in and constitute a part of the specification, illustrate embodiments, features, and aspects of the invention and, together with the description, serve to explain the principles of the invention.

DESCRIPTION OF THE EMBODIMENTS

Various embodiments, features, and aspects of the invention will be described in detail below with reference to the drawings. Each of the embodiments of the present invention described below can be implemented solely or as a combination of a plurality of the embodiments or features thereof where necessary or where the combination of elements or features from individual embodiments in a single embodiment is beneficial.

Figure 1:
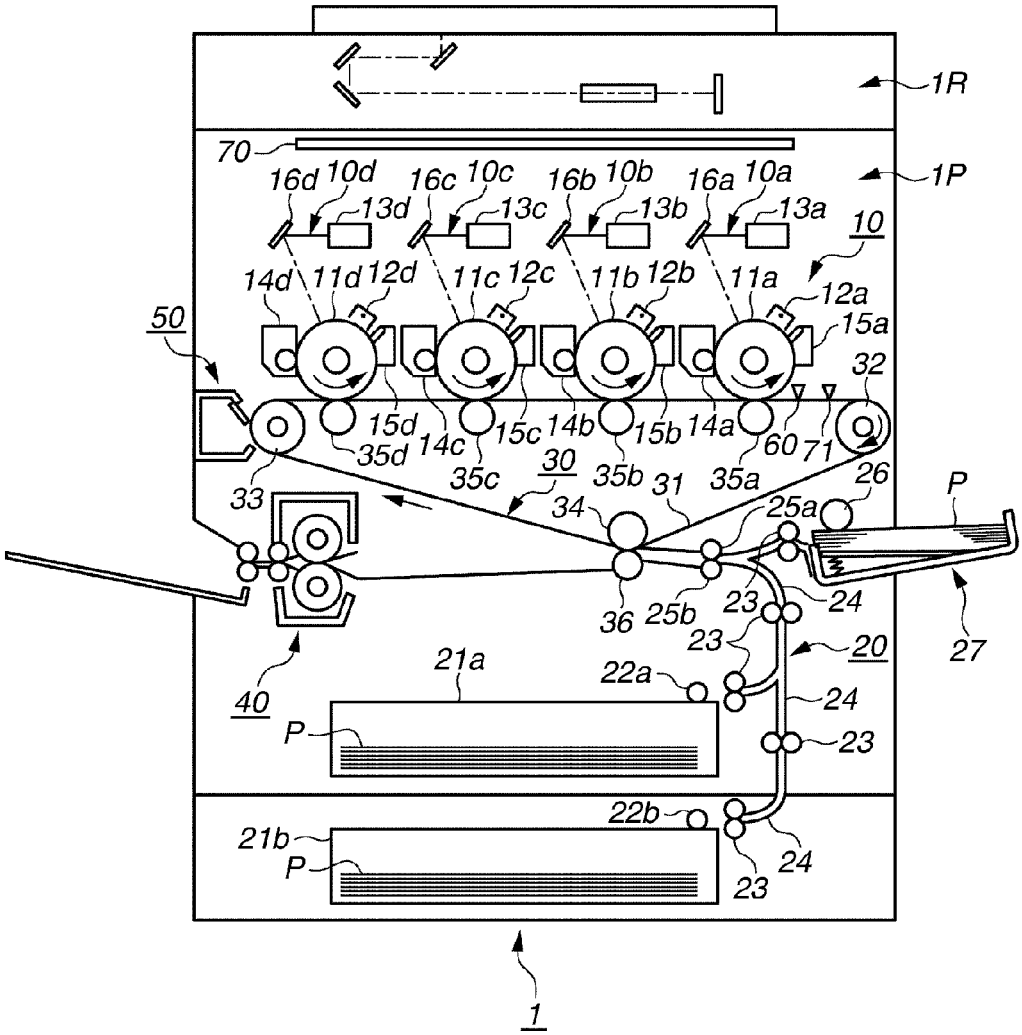
FIG. 1 is a schematic cross-sectional view of an image forming apparatus.

FIG. 1 is a schematic cross-sectional view of an image forming apparatus.

An image forming apparatus 1 according to an embodiment of the present invention is a color electrophotography apparatus which includes a plurality of parallel arranged image forming units and employs an intermediate transfer method. The image forming apparatus 1 includes a recorded image signal output unit 1R and an image output unit 1P. The image output unit 1P includes four image forming units 10 (10*a*, 10*b*, 10*c*, and 10*d*), which are arranged in parallel, a sheet feed unit 20, an intermediate transfer unit 30, a fixing unit 40, and a control unit 70. Each of these units will be described in detail below.

The image forming units 10*a* to 10*d* have a same configuration. Cylindrical electrophotography photosensitive members, in other words, photosensitive drums (image bearing members) 11*a* to 11*d* are included in the image forming units 10*a* to 10*d*, respectively. Each of the photosensitive drums 11*a* to 11*d* is rotatably supported by a shaft and rotates in a direction indicated by an arrow in the drawing. Facing the outer periphery of the photosensitive drums 11*a* to 11*d*, there are arranged primary charging devices 12*a* to 12*d*, exposure systems 13*a* to 13*d*, mirrors 16*a* to 16*d*, development devices 14*a* to 14*d*, and cleaning devices 15*a* to 15*d* in the rotation direction of the photosensitive drums.

Each of the primary charging devices 12*a* to 12*d* provides a uniform amount of charge on the surface of each of the photosensitive drums 11*a* to 11*d*. The optical systems 13*a* to 13*d* modulates light beams, e.g., laser beams, according to a recorded image signal output from the recorded image signal output unit 1R and exposes the respective photosensitive drums 11*a* to 11*d* with the modulated light beams via the mirrors 16*a* to 16*d*, so that an electrostatic latent image is formed on each of the corresponding photosensitive drums 11*a* to 11*d*.

Further, the electrostatic latent image formed on each of the photosensitive drums 11*a* to 11*d* is made visible by the development devices 14*a* to 14*d*, each of which contains developer (toner) of one of four colors (yellow, cyan, magenta, and black). The visible toner images are transferred onto an intermediate transfer belt 31 as a member of the intermediate transfer unit 30 by primary transfer rollers 35*a* to 35*d*. The cleaning devices 15*a* to 15*d* scrape off the toner remaining on the photosensitive drums 11*a* to 11*d* which is not transferred onto the intermediate transfer belt 31 and clean the drum surface.

A secondary transfer roller 36 transfers the toner image on the intermediate transfer belt 31 to a recording sheet P. A cleaning device 50 cleans the surface of the intermediate transfer belt 31. The cleaning device 50 includes a cleaning blade used for removing the toner on the intermediate transfer belt 31 and a waste toner box used for storing the waste toner.

The sheet feed unit 20 includes cassettes 21*a* and 21*b*, pick up rollers 22*a*, 22*b* and 26, pairs of sheet feed rollers 23, sheet feed guides 24, registration rollers 25*a* and 25*b*, and a manual feed tray 27. The recording sheet P stored in the cassettes 21*a* and 21*b* and the manual feed tray 27 is picked up by the respective pick up rollers 22*a*, 22*b* and 26. Then, the recording sheet P is conveyed to the registration rollers 25*a* and 25*b* by the pairs of sheet feed rollers 23. The registration rollers 25*a* and 25*b* convey the recording sheet P to the secondary transfer roller 36 in synchronization with the image formation of each image forming unit.

The fixing unit 40 includes a fixing roller including a heat source such as a halogen heater and a pressure roller which applies pressure to the fixing roller. A heat source may also be included in the pressure roller.

A density sensor 71 detects a pattern image transferred onto the intermediate transfer belt 31 from the photosensitive drums 11*a* to 11*d* when an image adjustment mode is executed.

Next, the operation of the image forming apparatus 1 having the above-described configuration will be described. When an image forming operation start signal is issued, the recording sheet P is picked up one by one from the cassette 21*a* by the pickup roller 22*a*. Then, the recording sheet P is guided between the sheet feed guide 24 and conveyed to the registration rollers 25*a* and 25*b* by the pairs of sheet feed rollers 23. At this time, the rotation of the registration rollers 25*a* and 25*b* is stopped. Accordingly, the leading edge of the recording sheet P abuts on the nip portion of the registration rollers 25*a* and 25*b*. After the abutment, the registration rollers 25*a* and 25*b* start to rotate in synchronization with the start of the image formation performed by the image forming unit. The rotation is started at such timing that the recording sheet P and the toner image primary-transferred to the intermediate transfer belt 31 by the image forming unit match at the secondary transfer roller 36.

In the image forming unit, when the image forming operation start signal is issued, a toner image formed on the photosensitive drum 11*d* by the above-described processes is primary transferred onto the intermediate transfer belt 31 by the high-voltage-applied primary transfer roller 35*d*. The primary transferred toner image is then conveyed to the following primary transfer roller 35*c*. At the primary transfer roller 35*c*, image formation is performed with a delay of time necessary for conveying the toner image from one image forming unit to the next. After positional alignment, the primary transfer roller 35*c* transfer the next toner image onto the image that has already been transferred. Similar processing is repeated at the following image forming units. Consequently, a toner image of four colors is primary transferred onto the intermediate transfer belt 31.

Then, the recording sheet P enters the position of the secondary transfer roller 36 and contacts the intermediate transfer belt 31. A high voltage is applied to the secondary transfer roller 36 at the timing when the recording sheet P passes the secondary transfer roller 36. Accordingly, the toner image of four colors formed on the intermediate transfer belt 31 is transferred onto the surface of the recording sheet P. Then, the recording sheet P is conveyed to the fixing unit 40. The fixing unit 40 fixes the toner image onto the surface of the recording sheet P by applying heat and pressure to the recording sheet P. Subsequently, the recording sheet P is discharged from the image forming apparatus.

Figure 2A:
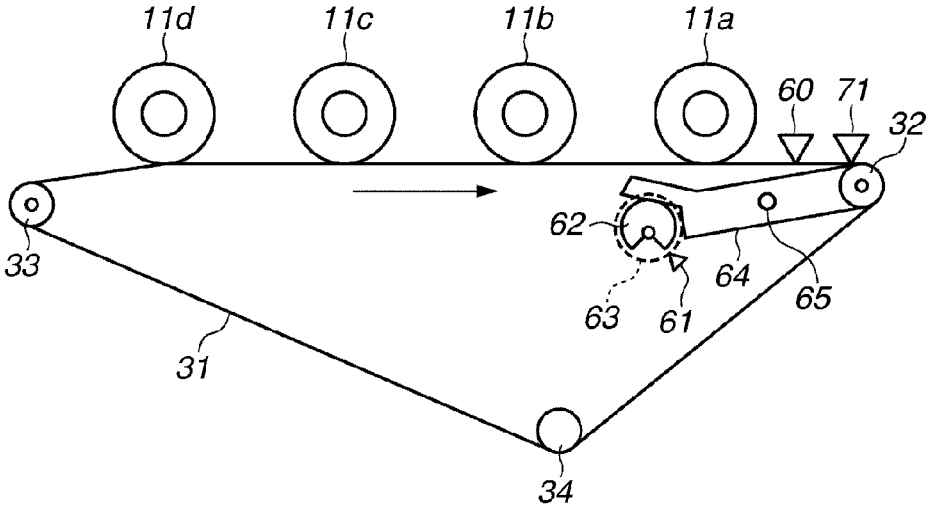
FIGS. 2A and 2B illustrate meandering correction control and an abutment/separation operation of an intermediate transfer belt.
Figure 2B:
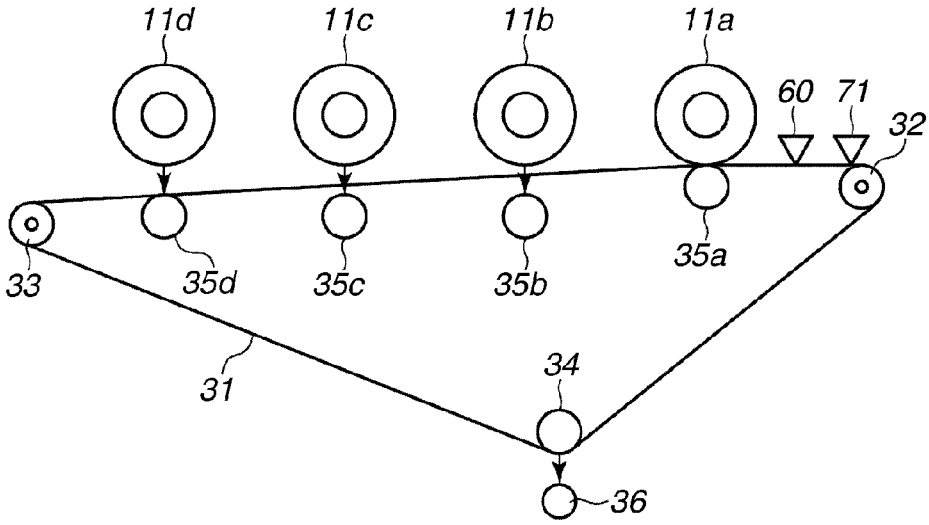

FIGS. 2A and 2B illustrate meandering correction control and an abutment/separation operation of the intermediate transfer belt.

In FIG. 2A, the intermediate transfer belt 31 is rotatably supported by a drive roller 33, a steering roller 32, and a secondary transfer counter roller 34 in the movement direction indicated by an arrow in the drawing. A primary transfer plane is formed between the drive roller 33 and the steering roller 32. Since the drive roller 33 transfers the drive to the intermediate transfer belt 31, the drive roller 33, which is a metal roller, is coated with rubber for preventing slippage between the roller and the belt. The thickness of the rubber is a few millimeters.

The steering roller 32 is rotated according to the rotation of the intermediate transfer belt 31. One end of the shaft of the steering roller 32 is fixed. The other end of the shaft is connected to a steering arm 64. The control unit 70 controls the drive of a steering motor 63, which is a stepping motor, and rotates a cam 62. When the cam 62 rotates, the steering arm 64 also rotates about a shaft 65. In other words, the tilt of the steering roller 32 is controlled by the control unit 70 controlling the rotational position of the cam 62.

A home position (HP) sensor 61 detects a home position as an initial position of the cam 62 by detecting a notch provided on the cam 62. The detection result of the HP sensor 61 is used for detecting the rotational angle of the cam 62.

An edge sensor 60 is arranged between the steering roller 32 and the photosensitive drum 11*a*. The edge sensor 60 detects a position of the edge of the intermediate transfer belt 31 in the width direction, which is the direction perpendicular to the movement direction, and generates an output signal according to the meandering of the intermediate transfer belt 31. Although the edge sensor 60 is an optical sensor that detects an amount of light corresponding to the position of a flag member that abuts an edge of the intermediate transfer belt 31, a different device, such as a line sensor, can be used so long as it can detect the edge position of the intermediate transfer belt 31.

In FIG. 2B, the primary transfer rollers 35*b* to 35*d* and the secondary transfer roller 36 are movably arranged so that they can abut on or be separated from the intermediate transfer belt 31.

For example, when the image forming apparatus is in a monochrome print mode and the image formation is performed using only the black color, the primary transfer rollers 35*b* to 35*d* move down to the separation position away from the photosensitive drums 11*b* to 11*d*. This configuration contributes to preventing degradation of the photosensitive drums 11*b* to 11*d* and the intermediate transfer belt 31 due to friction between the photosensitive drums 11*b* to 11*d* (i.e., photosensitive drums of yellow, magenta, and cyan colors that are not used) and the intermediate transfer belt 31.

On the other hand, when the image forming apparatus is in a color print mode and the image formation is performed by using all of the four colors, unlike the case with the monochrome print mode, the primary transfer rollers 35*b* to 35*d* move up to the abutment position so that the intermediate transfer belt 31 contacts the photosensitive drums 11*b* to 11*d*.

Further, when the image forming apparatus is in an image adjustment mode, a density of a pattern image transferred onto the intermediate transfer belt 31 from the photosensitive drums 11*a* to 11*d* is read by the density sensor 71. At this time, if the secondary transfer roller 36 is in contact with the secondary transfer counter roller 34, the toner of the pattern image may stain the secondary transfer roller 36 when the pattern image passes by the secondary transfer position.

Thus, when the image forming apparatus is in the image adjustment mode, the secondary transfer roller 36 is separated from the secondary transfer counter roller 34. The pattern image that passed the secondary transfer position is cleaned by the cleaning device 50.

Figure 3A:
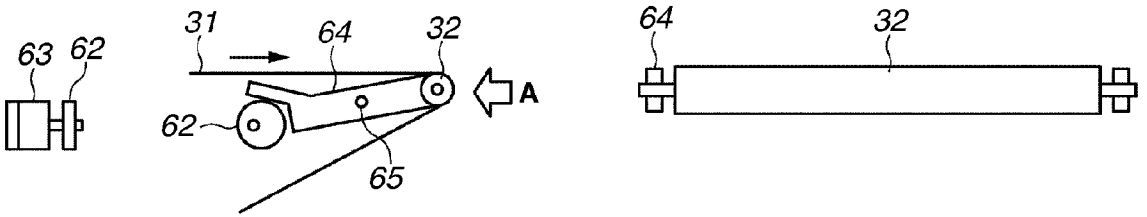
FIGS. 3A to 3C illustrate principles of a meandering correction of the intermediate transfer belt.
Figure 3B:
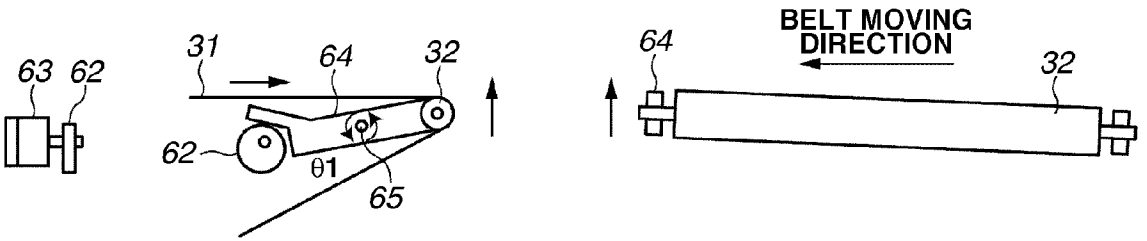
Figure 3C:
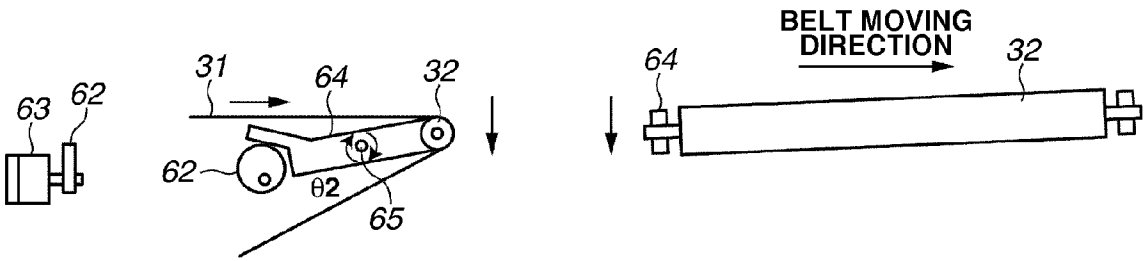

FIGS. 3A to 3C illustrate principles of the meandering correction of the intermediate transfer belt. In each of FIGS. 3A to 3C, the left illustration is a front view of the cam 62, the center illustration is a side view of the cam 62 and the steering roller 32, and the right illustration is a front view of the steering roller 32. The front view of the steering roller 32 is obtained by viewing the steering roller 32 illustrated in the side view from a viewpoint A in the direction of the arrow.

As illustrated in FIG. 3A, when the cam 62 stops at a predetermined angle and the steering roller 32 is hold at a substantially horizontal position (approximately level) corresponding to the stop angle, basically, a force that corrects the position of the intermediate transfer belt does not act.

As illustrated in FIG. 3B, if the cam 62 rotates according to the drive of the steering motor 63 from the state in FIG. 3A, then, the steering arm 64 moves in the direction of an arrow 81 according to an eccentricity amount of the cam 62. Since one end of the steering roller 32 is raised by the steering arm 64, the steering roller 32 is tilted corresponding to the amount the steering roller 32 is raised.

At this time, the intermediate transfer belt 31 wound around the steering roller 32 moves to the side of the roller end which has been raised by the steering arm 64. This is because when the intermediate transfer belt 31 passes by the steering roller 32, the traveling direction of the intermediate transfer belt 31 wound around the steering roller 32 is shifted to the outside of the end of the steering roller 32 which has been raised.

On the other hand, as illustrated in FIG. 3C, if the cam 62 rotates according to the drive of the steering motor 63 from the state in FIG. 3A, then, the steering arm 64 moves in the direction of an arrow 82 according to an eccentricity amount of the cam 62. Since one end of the steering roller 32 is lowered by the steering arm 64, the steering roller 32 is tilted corresponding to the amount the steering roller 32 is lowered.

At this time, the intermediate transfer belt 31 wound around the steering roller 32 moves to the side opposite the roller end which has been lowered by the steering arm 64. This is because when the intermediate transfer belt 31 passes by the steering roller 32, the traveling direction of the intermediate transfer belt 31 wound around the steering roller 32 is shifted to the inside of the end of the steering roller 32 which has been lowered.

The control unit 70 controls the tilt of the steering roller 32 so that the intermediate transfer belt 31 moves in a direction opposite to the meandering direction of the intermediate transfer belt 31. In this manner, the meandering of the intermediate transfer belt 31 can be corrected.

Figure 4:
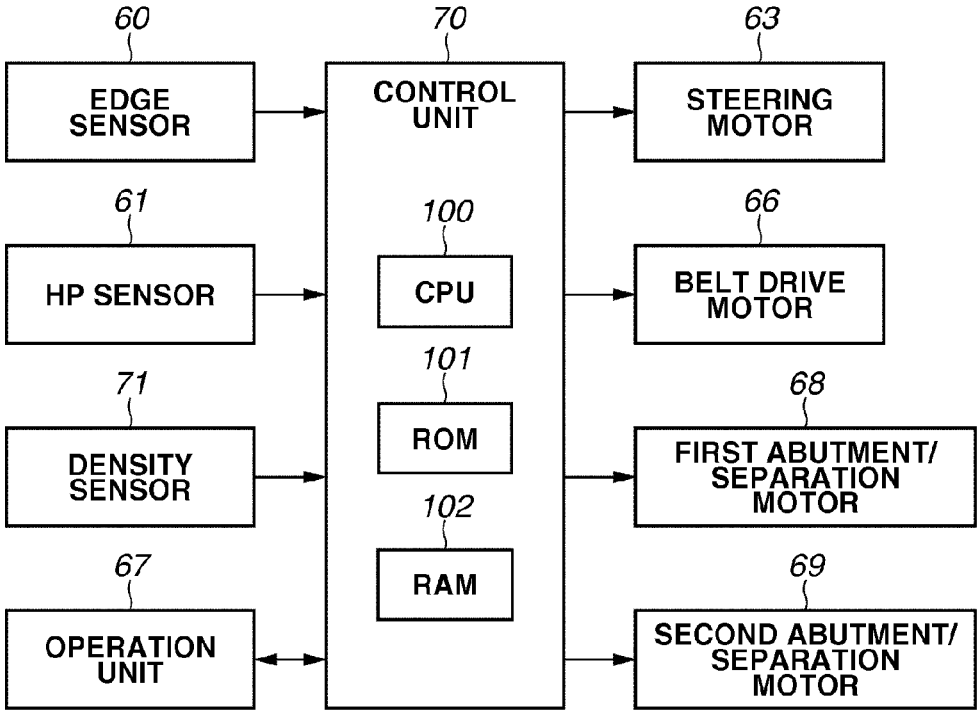
FIG. 4 is a control block diagram of the image forming apparatus.

FIG. 4 is a control block diagram of the image forming apparatus 1. The control unit 70 includes a central processing unit (CPU) 100, a read-only memory (ROM) 101, and a random access memory (RAM) 102. The CPU 100 is a control circuit that controls the entire image forming apparatus 1. Control programs used for controlling various types of processing executed by the image forming apparatus 1 is stored in the ROM 101. The RAM 102 is a system work memory used for operating the CPU 100. The RAM 102 also functions as an image memory used for temporary storing image data. An operation unit 67 includes a touch panel display and receives an operation instruction input by the user.

A belt drive motor 66 drives the drive roller 33 that rotates the intermediate transfer belt 31. The CPU 100 controls the current that flows to the belt drive motor 66 and controls the rotation speed of the intermediate transfer belt 31.

A first abutment/separation motor 68 is used for attaching and separating the intermediate transfer belt 31 to and from with the photosensitive drums 11*b* to 11*d*. When the intermediate transfer belt 31 is attached to the photosensitive drums 11*b* to 11*d*, the CPU 100 controls the first abutment/separation motor 68 so that the primary transfer rollers 35*b* to 35*d* move up. Further, when the intermediate transfer belt 31 is separated from the photosensitive drums 11*b* to 11*d*, the CPU 100 controls the first abutment/separation motor 68 so that the primary transfer rollers 35*b* to 35*d* move down.

A second abutment/separation motor 69 is used for attaching and separating the intermediate transfer belt 31 to and from the secondary transfer roller 36. When the intermediate transfer belt 31 is attached to the secondary transfer roller 36, the CPU 100 controls the second abutment/separation motor 69 so that the secondary transfer roller 36 moves up. Further, when the intermediate transfer belt 31 is separated from the secondary transfer roller 36, the CPU 100 controls the second abutment/separation motor 69 so that the secondary transfer roller 36 moves down.

Detection signals of the edge sensor 60 and the HP sensor 61 are transmitted to the CPU 100. The detection signal is converted from an analog signal to a digital signal by an analog-to-digital (AD) conversion circuit integrated in the CPU 100. Then, the converted signal goes under calculation processing by the CPU 100. The CPU 100 controls the current supplied to the steering motor 63 based on the detection signals acquired from the edge sensor 60 and the HP sensor 61. The cam 62 rotates according to this control and the tilt of the steering roller 32 is controlled.

When the intermediate transfer belt 31 is stably conveyed, the conveyance stability of the intermediate transfer belt 31 may be impaired if the abutment state and the separation state is switched therebetween due to the drive of at least one of the primary transfer rollers 35*b* to 35*d* and the secondary transfer roller 36. Thus, the intermediate transfer belt 31 temporarily exhibits a large meandering after the abutment operation or the separation operation, which results in color misregistration. Thus, according to the present embodiment, the position of the cam 62, which contributes to stable conveyance of the intermediate transfer belt 31, is calculated for each of the plurality of modes. The calculation processing will be described with reference to the flowcharts below.

Figure 5:
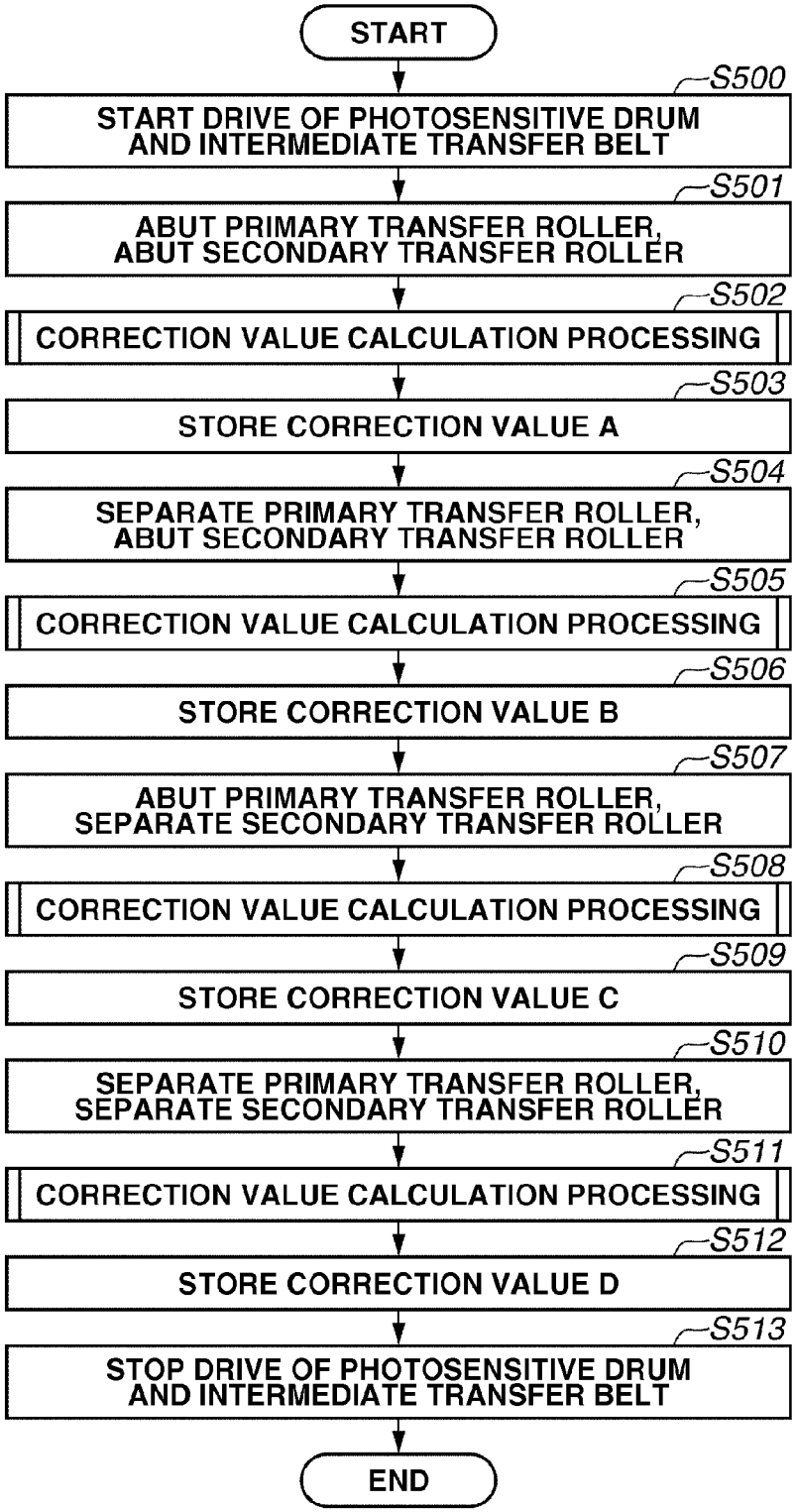
FIG. 5 is a flowchart illustrating calculation processing of a correction value of an initial position of a cam in each mode.

FIG. 5 is a flowchart illustrating the correction value calculation processing of the initial position of the cam in each mode. A program for executing the processing illustrated in the flowchart is stored in the ROM 101 and the program is read therefrom and executed by the CPU 100. The processing in the flowchart is executed by an instruction issued via the operation unit 67 when the image forming apparatus is in the standby state.

In step S500, the CPU 100 starts the rotation of the photosensitive drums 11*a* to 11*d* and the intermediate transfer belt 31. In step S501, the CPU 100 controls the first abutment/separation motor 68 and the second abutment/separation motor 69 so that the primary transfer rollers 35*b* to 35*d* abut the intermediate transfer belt 31 and the secondary transfer roller 36 abuts the intermediate transfer belt 31.

In step S502, the CPU 100 calculates a correction value A of a position of the cam 62 at which the intermediate transfer belt 31 can be stably conveyed. Details of the correction value calculation processing will be described below with reference to FIG. 6. In step S503, the CPU 100 stores the correction value A in the RAM 102. The stored correction value A is used when the color print mode is executed.

In step S504, the CPU 100 controls the first abutment/separation motor 68 and the second abutment/separation motor 69 so that the primary transfer rollers 35*b* to 35*d* are separated from the intermediate transfer belt 31 and the secondary transfer roller 36 abuts the intermediate transfer belt 31.

In step S505, the CPU 100 calculates a correction value B of a position of the cam 62 at which the intermediate transfer belt 31 can be stably conveyed. Details of the correction value calculation processing will be described below with reference to FIG. 6. In step S506, the CPU 100 stores the correction value B in the RAM 102. The stored correction value B is used when the monochrome print mode is executed.

In step S507, the CPU 100 controls the first abutment/separation motor 68 and the second abutment/separation motor 69 so that the primary transfer rollers 35*b* to 35*d* abut the intermediate transfer belt 31 and the secondary transfer roller 36 is separated from the intermediate transfer belt 31.

In step S508, the CPU 100 calculates a correction value C of a position of the cam 62 at which the intermediate transfer belt 31 can be stably conveyed. Details of the correction value calculation processing will be described below with reference to FIG. 6. In step S509, the CPU 100 stores the correction value C in the RAM 102. The stored correction value C is used when the color image adjustment mode is executed.

In step S510, the CPU 100 controls the first abutment/separation motor 68 and the second abutment/separation motor 69 so that the primary transfer rollers 35*b* to 35*d* are separated from the intermediate transfer belt 31 and the secondary transfer roller 36 is separated from the intermediate transfer belt 31.

In step S511, the CPU 100 calculates a correction value D of a position of the cam 62 at which the intermediate transfer belt 31 can be stably conveyed. Details of the correction value calculation processing will be described below with reference to FIG. 6. In step S512, the CPU 100 stores the correction value D in the RAM 102. The stored correction value D is used when a monochrome image adjustment mode is executed.

In step S513, the CPU 100 stops the rotation of the photosensitive drums 11*a* to 11*d* and the intermediate transfer belt 31. Then, the processing in the flowchart ends, and the image forming apparatus is changed to the standby state again.

Figure 6:
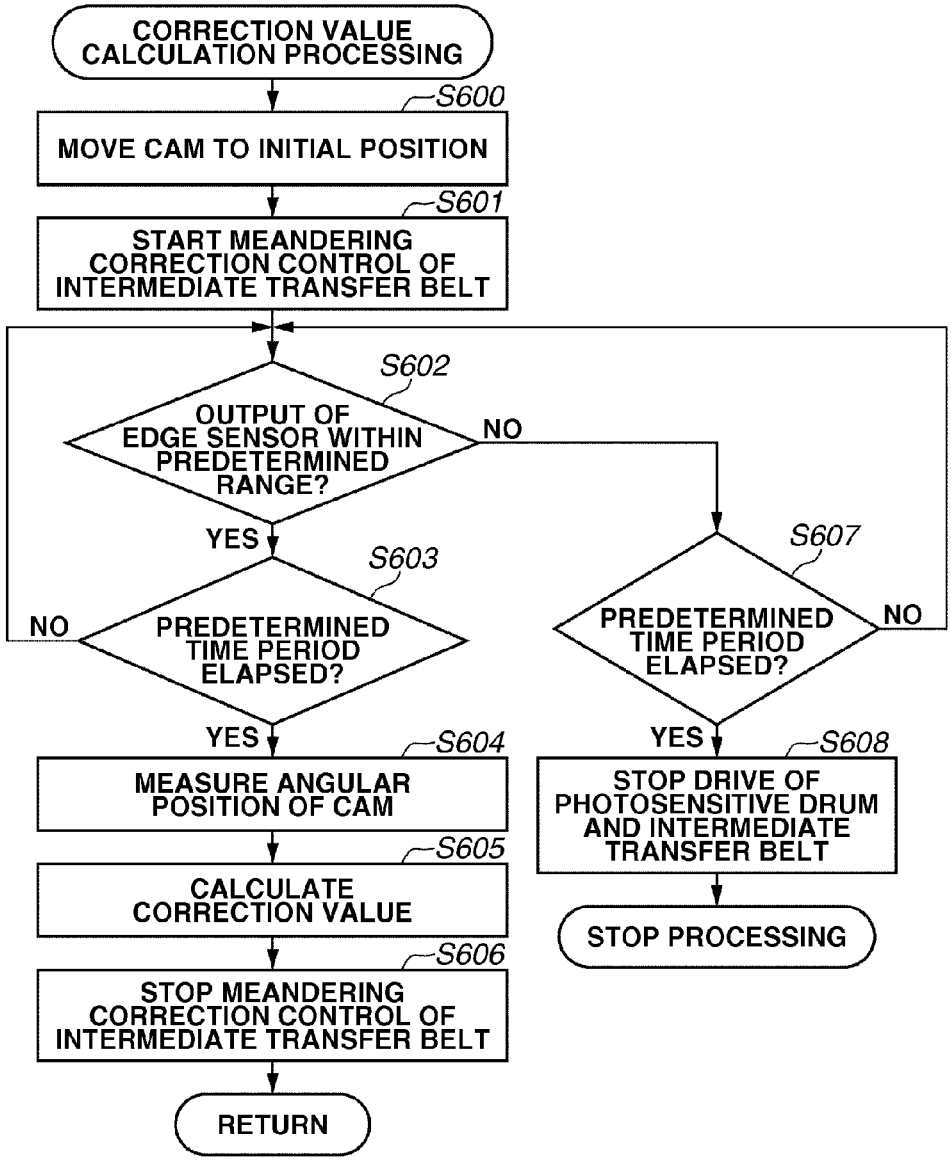
FIG. 6 is a flowchart illustrating subroutines of the correction value calculation processing in steps S502, S505, S508, and S511 of the flowchart in FIG. 5.

FIG. 6 is a flowchart illustrating a subroutine of the correction value calculation processing performed in steps S502, S505, S508, and S511 of the flowchart in FIG. 5.

A program for executing the processing illustrated in the flowchart is stored in the ROM 101 and the program is read therefrom and executed by the CPU 100.

In step S600, based on an output from the HP sensor 61, the CPU 100 controls the steering motor 63 so that the cam 62 moves to the initial position (home position). In step S601, the CPU 100 starts the meandering correction control of the intermediate transfer belt 31. When the CPU 100 performs the meandering correction control, the CPU 100 controls the steering motor 63 such that the output from the edge sensor 60 is equal to a target value (2.5 V).

In step S602, the CPU 100 determines whether the output from the edge sensor 60 is within a predetermined range (2.4 V to 2.6 V). If the output from the edge sensor 60 is within the predetermined range (YES in step S602), the processing proceeds to step S603. In step S603, the CPU 100 determines whether a predetermined time (30 seconds) has elapsed since the output is within the predetermined range.

If the predetermined time has not elapsed (NO in step S603), the processing returns to step S602. On the other hand, if the predetermined time has elapsed (YES in step S603), it is conceivable that the cam 62 is at an angular position that can realize the stable conveyance of the intermediate transfer belt 31, and the processing proceeds to step S604. In step S604, the CPU 100 measures the position of the cam 62.

More particularly, the CPU 100 sets the home position which is detected based on the output by the HP sensor 61 as a reference position, and measures the angular position of the cam 62 according to a pulse number used for driving the steering motor 63. The measured angular position of the cam 62 corresponds to a tilted position of the steering roller 32 that can stably convey the intermediate transfer belt 31.

Since the angular position of the cam 62 is detected during the meandering correction control, the pulse number of the steering motor 63 changes from moment to moment. Thus, according to the present embodiment, an average of 100 pieces of sampling data obtained by measuring the pulse for approximately 10 seconds at regular intervals of 0.1 second is used in order to reduce measurement errors.

In step S605, the CPU 100 calculates an rotation amount of the cam from the home position as a correction value based on the angular position detected in step S604. In step S606, the CPU 100 stops the meandering correction control of the intermediate transfer belt 31, and then the processing ends.

On the other hand, in step S602, if the output from the edge sensor 60 is not within the predetermined range (NO in step S602), the processing proceeds to step S607. In step S607, the CPU 100 determines whether, a predetermined time (two minutes) has elapsed since the output is not within the predetermined range.

If the predetermined time has not elapsed yet (NO in step S607), the processing returns to step S602. On the other hand, if the predetermined time has elapsed (YES in step S607), it is conceivable that the meandering correction control in the image forming apparatus 1 is not stable due to some defects, and the processing proceeds to step S608. In step S608, the CPU 100 does not calculate the correction value and stops the drive of the photosensitive drums 11*a* to 11*d* and the intermediate transfer belt 31. Then, the execution of the processing in the flowchart in FIG. 6 is stopped.

Figure 7:
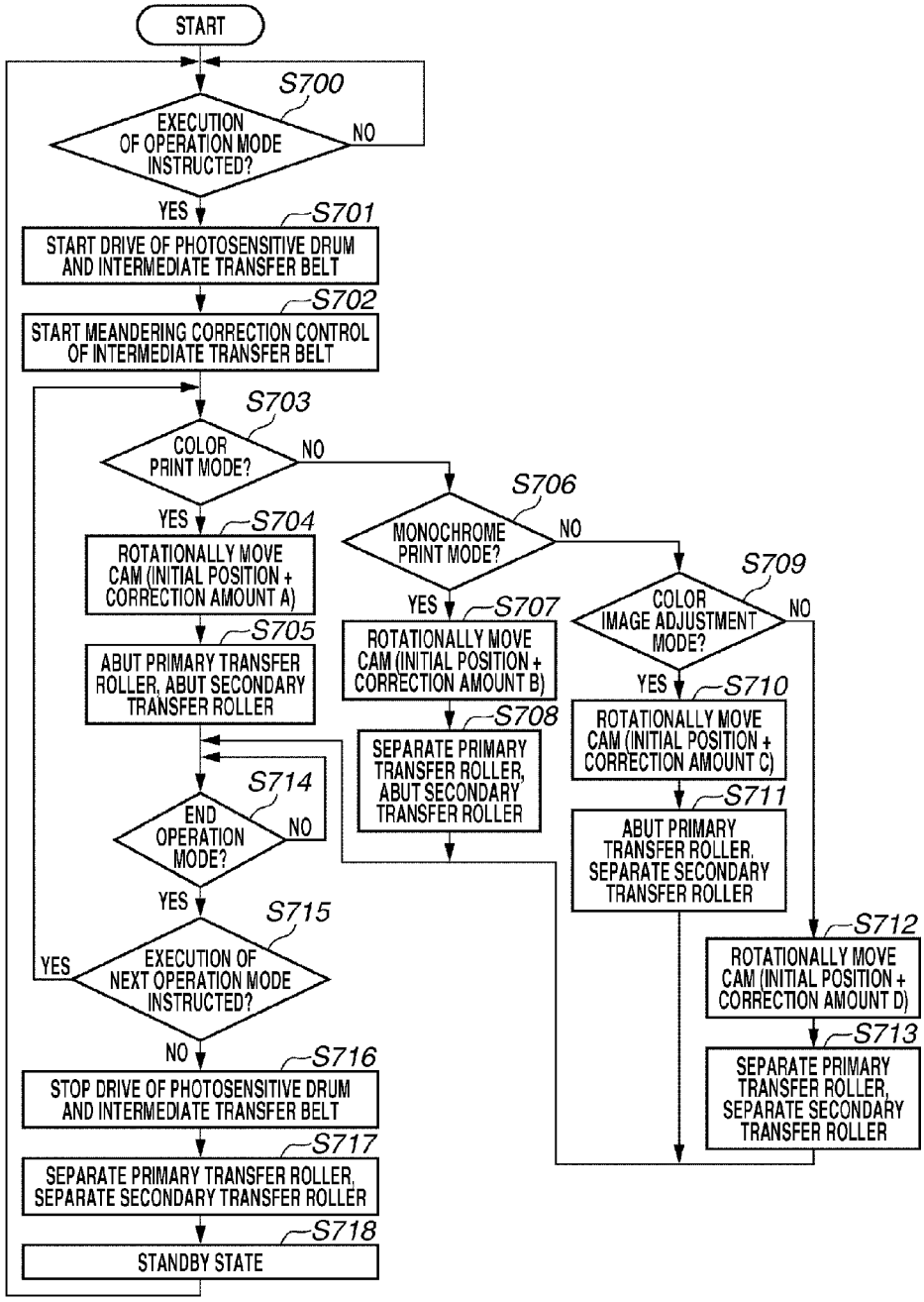
FIG. 7 is a flowchart illustrating control of the cam in each operation mode of the image forming apparatus.

FIG. 7 is a flowchart illustrating control of the cam in each operation mode of the image forming apparatus.

A program for executing the processing illustrated in the flowchart is stored in the ROM 101 and the program is read therefrom and executed by the CPU 100. The processing in the flowchart is executed when power is supplied to the image forming apparatus 1, the initial operation of the image forming apparatus 1 is finished, and the image forming apparatus 1 is in the standby state. When the image forming apparatus 1 is in the standby state, the primary transfer rollers 35*b* to 35*d* and the secondary transfer roller 36 are separated from the intermediate transfer belt 31.

In step S700, the CPU 100 waits until execution of an operation mode is instructed via the operation unit 67. The operation mode is any of the color print mode, the monochrome print mode, the color image adjustment mode, and the monochrome image adjustment mode. If execution of any one of the operation mode is instructed (YES in step S700), the processing proceeds to step S701. In step S701, the CPU 100 starts the rotation of the photosensitive drums 11*a* to 11*d* and the intermediate transfer belt 31. In step S702, the CPU 100 starts the meandering correction control of the intermediate transfer belt 31. When the CPU 100 performs the meandering correction control, the CPU 100 controls the steering motor 63 such that the output from the edge sensor 60 is equal to a target value (2.5 V).

In step S703, the CPU 100 determines whether the operation mode instructed via the operation unit 67 is the color print mode. If the instructed operation mode is the color print mode (YES in step S703), the processing proceeds to step S704. In step S704, the CPU 100 controls the steering motor 63 so that the cam 62 is moved to a position that can realize the stable conveyance of the intermediate transfer belt 31 in the color print mode.

The target position of the cam 62 in the color print mode can be obtained by adding the correction value A stored in step S503 in FIG. 5 to the initial position (home position). Thus, the CPU 100 calculates the control amount of the steering motor 63 according to the equation (1) below.

$$\text{control amount} = \text{initial position} + \text{correction amount } A - \text{current position} \quad (1)$$

In step S705, the CPU 100 controls the first abutment/separation motor 68 and the second abutment/separation motor 69 so that the primary transfer rollers 35*b* to 35*d* abut the intermediate transfer belt 31 and the secondary transfer roller 36 abuts the intermediate transfer belt 31.

Further, in step S703, if the instructed operation mode is determined as not the color print mode (NO in step S703), the processing proceeds to step S706. In step S706, the CPU 100 determines whether the operation mode instructed via the operation unit 67 is the monochrome print mode. If the instructed operation mode is the monochrome print mode (YES in step S706), the processing proceeds to step S707. In step S707, the CPU 100 controls the steering motor 63 so that the cam 62 is moved to a position that can realize the stable conveyance of the intermediate transfer belt 31 in the monochrome print mode.

The target position of the cam 62 in the monochrome print mode can be obtained by adding the correction value B stored in step S506 in FIG. 5 to the initial position (home position). Thus, the CPU 100 calculates the control amount of the steering motor 63 according to the equation (2) below.

$$\text{control amount} = \text{initial position} + \text{correction amount } B - \text{current position} \quad (2)$$

In step S708, the CPU 100 maintains the state of the primary transfer rollers 35*b* to 35*d* at positions separated from the intermediate transfer belt 31 but controls the second abutment/separation motor 69 so that the secondary transfer roller 36 abuts the intermediate transfer belt 31.

Further, in step S706, if the instructed operation mode is determined as not the monochrome print mode (NO in step S706), the processing proceeds to step S709. In step S709, the CPU 100 determines whether the operation mode instructed via the operation unit 67 is the color image adjustment mode. If the instructed operation mode is the color image adjustment mode (YES in step S709), the processing proceeds to step S710. In step S710, the CPU 100 controls the steering motor 63 so that the cam 62 is moved to a position that can realize the stable conveyance of the intermediate transfer belt 31 in the color image adjustment mode.

The target position of the cam 62 in the color image adjustment mode can be obtained by adding the correction value C stored in step S509 in FIG. 5 to the initial position (home position). Thus, the CPU 100 calculates the control amount of the steering motor 63 according to the equation (3) below.

$$\text{control amount} = \text{initial position} + \text{correction amount } C - \text{current position} \quad (3)$$

In step S711, the CPU 100 controls the first abutment/separation motor 68 so that the primary transfer rollers 35*b* to 35*d* abut the intermediate transfer belt 31 while the secondary transfer roller 36 is maintained at the position separated from the intermediate transfer belt 31.

Further, in step S709, if the instructed operation mode is determined as not the color image adjustment mode (NO in step S709), the processing proceeds to step S712. In step S712, the CPU 100 controls the steering motor 63 so that the cam 62 is moved to a position that can realize the stable conveyance of the intermediate transfer belt 31 in the monochrome image adjustment mode.

The target position of the cam 62 in the monochrome image adjustment mode can be obtained by adding the correction value D stored in step S512 in FIG. 5 to the initial position (home position). Thus, the CPU 100 calculates the control amount of the steering motor 63 according to the equation (4) below.

$$\text{control amount} = \text{initial position} + \text{correction amount } D - \text{current position} \quad (4)$$

In step S713, the CPU 100 maintains the states of the primary transfer rollers 35*b* to 35*d* and the secondary transfer roller 36 so that they are separated from the intermediate transfer belt 31.

In step S714, the CPU 100 determines whether the operation of the operation mode is finished. If the operation is finished (YES in step S714), the processing proceeds to step S715. In step S715, the CPU 100 determines whether an execution instruction of a next operation mode is received based on an instruction from the operation unit 67. If an instruction of the next operation mode is received (YES in step S715), the processing returns to step S703. Whereas, if an instruction of the next operation mode is not received (NO in step S715), the processing proceeds to step S716. In step S716, the CPU 100 stops the drive of the photosensitive drums 11*a* to 11*d* and the intermediate transfer belt 31.

In step S717, the CPU 100 controls the first abutment/separation motor 68 and the second abutment/separation motor 69 so that the primary transfer rollers 35*b* to 35*d* and the secondary transfer roller 36 are separated from the intermediate transfer belt 31. In step S718, the CPU 100 changes the state of the image forming apparatus 1 to the standby state, and the processing returns to step S700.

According to the processing described above, the meandering amount of the intermediate transfer belt 31 due to the abutment/separation operation can be satisfactorily reduced if the operation mode of the currently operating image forming apparatus 1 is changed to a different operation mode without stopping the drive of the intermediate transfer belt 31. The effect according to the present embodiment will now be described taking an example of a case where the operation mode is changed from the color image adjustment mode to the color print mode.

Figure 8A:
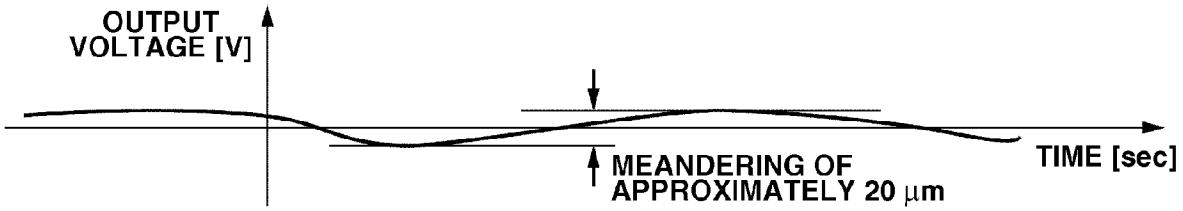
FIGS. 8A to 8C illustrate waveforms detected by an edge sensor in a case where a position correction control of a cam according to an embodiment is executed and is not executed when the operation mode is changed from a color image adjustment mode to a color print mode.
Figure 8B:
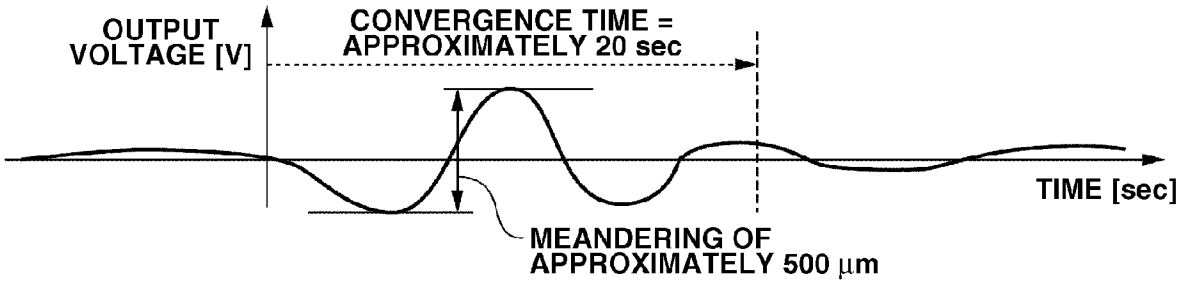
Figure 8C:
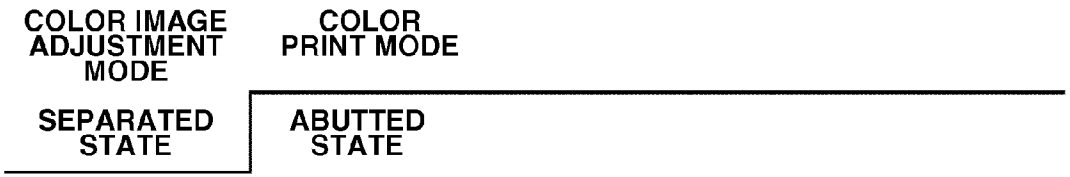

FIG. 8A illustrates a waveform detected by the edge sensor when the position correction control of the cam according to the present embodiment is performed. FIG. 8B illustrates a waveform detected by the edge sensor when the position correction control of the cam according to the present embodiment is not performed. FIG. 8C illustrates an abutment state and a separation state of the secondary transfer roller when the operation mode is changed from the color image adjustment mode to the color print mode.

As illustrated in FIGS. 8B and 8C, if the position correction control of the cam 62 is not executed at the moment the operation mode is changed from the color image adjustment mode to the color print mode, the output waveform of the edge sensor 60 shows an amount of meandering of approximately 500 μm. Further, approximately 20 seconds are required for the fluctuated waveform to converge on its original state.

On the other hand, as illustrated in FIG. 8A, if the position correction control of the cam 62 is executed, at the moment the secondary transfer roller 36 abuts the intermediate transfer belt 31, the angular position of the cam 62 is optimized. Thus, the amount of meandering of the intermediate transfer belt 31 is reduced to approximately 20 μm. Accordingly, even if the image forming is immediately started, an image of a desired image quality can be obtained.

Figure 9A:
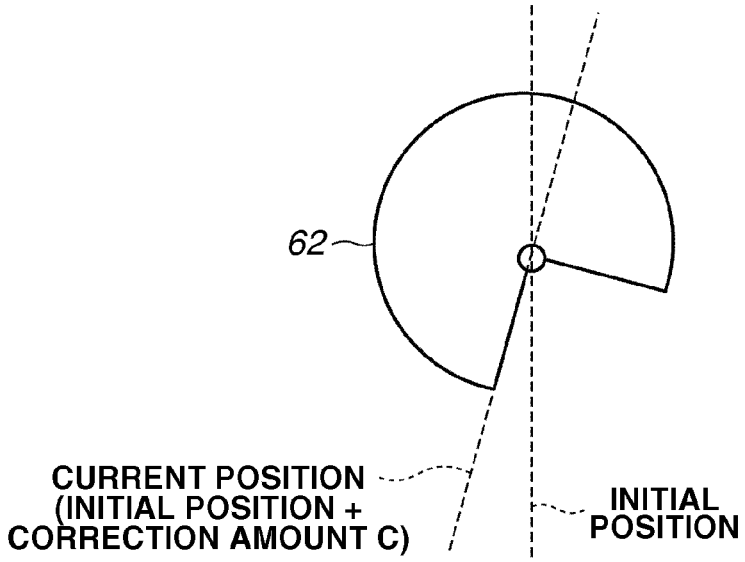
FIGS. 9A and 9B illustrate the position correction control of the cam when the operation mode is changed from the color image adjustment mode to the color print mode.
Figure 9B:
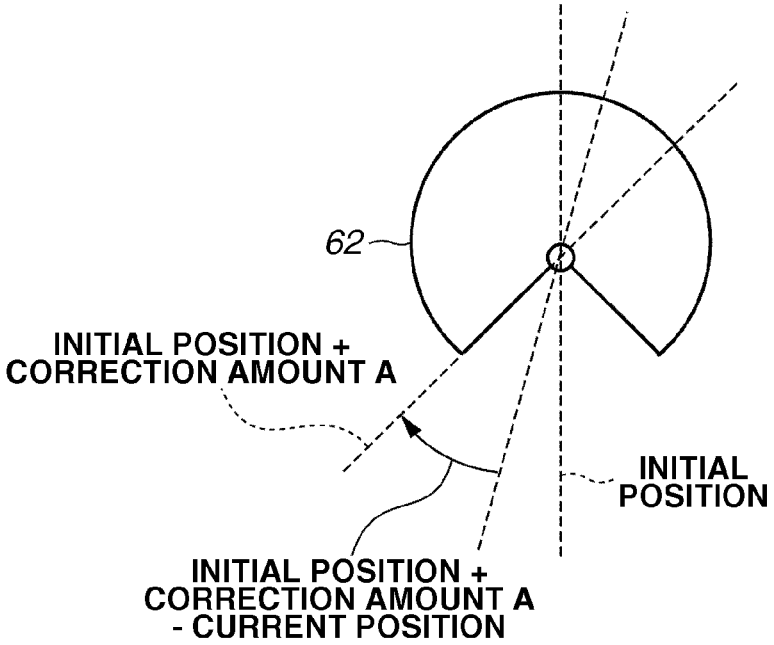

FIGS. 9A and 9B illustrate the position correction control of the cam when the operation mode is changed from the color image adjustment mode to the color print mode.

FIG. 9A illustrates the position of the cam 62 immediately after the operation mode is changed to the color image adjustment mode. FIG. 9B illustrates the position of the cam 62 immediately after the operation mode is changed to the color print mode.

In the color image adjustment mode illustrated in FIG. 9A, the conveyance of the intermediate transfer belt 31 can be stabilized by the cam 62 rotationally moving to an angular position of "initial position+correction amount C". If the operation mode is changed from the color image adjustment mode to the color print mode, according to the calculation processing based on the above-described equation (1), the CPU 100 controls the steering motor 63 for an amount corresponding to "initial position+correction amount A−current position". According to this control, if the operation mode is changed to the color print mode, the cam 62 moves to the position of "initial position+correction amount A" and the meandering of the intermediate transfer belt 31 is reduced. Accordingly, the intermediate transfer belt 31 can be stably conveyed.

As described above, according to the present embodiment, meandering of the intermediate transfer belt 31 which occurs due to abutment or separation of the rotatable member with respect to the intermediate transfer belt 31 while the intermediate transfer belt 31 is conveyed can be reduced. Further, according to the present embodiment, the time that elapses from the abutment or separation operation of the rotatable member with respect to the intermediate transfer belt 31 to the stable conveyance of the intermediate transfer belt 31 can be shortened. Accordingly, productivity can be improved.

According to the present embodiment, although the correction values A to D of the four modes are calculated at a time as illustrated in the flowchart in FIG. 5, different calculation methods can be used. For example, an instruction can be issued via the operation unit 67 such that only a correction value of a specific mode is calculated.

Further, according to the present embodiment, the meandering control of the intermediate transfer belt 31 is taken as an example. However, the meandering control of the present invention can be applied to a different type of belt. For example, the present invention can be applied to a conveyance belt, which conveys a recording sheet onto which a toner image on a photosensitive drum is to be transferred to the photosensitive drum.

Further, according to the present embodiment, although the primary transfer rollers 35*b* to 35*d* and the secondary transfer roller 36 are described as the rotatable members which abut on and are separated from the intermediate transfer belt 31, the rotatable members are not limited to such rollers. For example, the present invention can be applied to a cleaner roller that cleans the surface of the intermediate transfer belt 31 by abutting thereon and being separated therefrom.

Further, according to the present embodiment, although a color image forming apparatus is taken as an example, the image forming apparatus according to the present invention can be a monochrome image forming apparatus including an intermediate transfer belt. If the apparatus is a monochrome image forming apparatus, the configuration for attaching and separating the primary transfer roller to and from the intermediate transfer belt is unnecessary. However, the present invention can be applied to the configuration for attaching and separating the secondary transfer roller to and from the intermediate transfer belt.

While the present invention has been described with reference to embodiments, it is to be understood that the invention is not limited to the disclosed embodiments. The scope of the following claims is to be accorded the broadest interpretation so as to encompass all modifications, equivalent structures, and functions.

This application claims priority from Japanese Patent Application No. 2011-135105 filed Jun. 17, 2011, which is hereby incorporated by reference herein in its entirety.

What is claimed is:

1. An image forming apparatus comprising:

a first and a second image bearing members configured to carry toner images;

a belt configured to move along a predetermined direction;

a steering roller configured to steer the belt in a width direction perpendicular to the predetermined direction;

a tilting unit configured to tilt a shaft of the steering roller;

a detection unit configured to detect a position of the belt in the width direction;

a changing portion configured to change an abutment between the belt and the first and the second image bearing members to at least a first mode in which the belt abuts to the first and the second image bearing members and a second mode in which the belt abuts to the first image bearing member and the belt is separated from the second image bearing member;

an execution portion configured to execute an acquisition mode to acquire a first tilted position value of the shaft of the steering roller and a second tilted position value of the shaft of the steering roller at a timing other than performing an image forming operation while the belt is conveyed, wherein the first tilted position value is acquired when a predetermined time has elapsed in a state that an output of the detection unit is in a predetermined range, as a first tilted position value at which meandering of the belt is prevented in the first mode, the second tilted position value is acquired when a predetermined time has elapsed in a state that an output of the detection unit is in a predetermined range, as a second tilted position value at which meandering of the belt is prevented in the second mode; and a control unit configured to control the tilting unit to tilt the shaft of the steering roller based on an output of the detection unit while the image forming operation is performed so as to tilt the shaft of the steering roller to a first tilted position by using the first tilted position value when the changing portion changes the second mode to the first mode while the belt is conveyed and so as to tilt the shaft of the steering roller to a second tilted position by using the second tilted position value when the changing portion changes the first mode to the second mode while the belt is conveyed.

2. The image forming apparatus according to claim 1, wherein, while the belt is conveyed, the execution portion stops driving of the first and the second image bearing members and the belt when a predetermined time has elapsed in a state that an output of the detection unit is out of the predetermined range.

3. The image forming apparatus according to claim 1, wherein the tilting unit includes a cam which is rotationally driven so as to tilt the shaft of the steering roller, wherein the control unit is configured to control a tilt of the shaft of the steering roller by controlling the rotational position of the cam.

4. The image forming apparatus according to claim 3, further comprising:

a second detection unit configured to detect an initial position of the cam, wherein the control unit is configured to use a first correction value when the cam is moved to a first position and to use a second correction value when the cam is moved to a second position, wherein the first correction value is a difference between a first position value of the cam when the steering roller is at the first tilted position and the initial position value of the cam, and the second correction value is a difference between a second position value of the cam when the steering roller is at the second tilted position and the initial position value of the cam.

5. The image forming apparatus according to claim 1, wherein the belt is either an intermediate transfer belt onto which a toner image is transferred from one or more image bearing members or a conveyance belt which conveys a recording sheet to the one or more image bearing members.

* * * * *